United States Patent [19]

Lloyd et al.

[11] Patent Number: 5,050,805

[45] Date of Patent: Sep. 24, 1991

[54] NOISE ATTENUATING SUPERSONIC NOZZLE

[75] Inventors: Daniel L. Lloyd, Mason; Richard J. Madlener, Cincinnati, both of Ohio

[73] Assignee: Cold Jet, Inc., Loveland, Ohio

[21] Appl. No.: 506,556

[22] Filed: Apr. 6, 1990

Related U.S. Application Data

[63] Continuation of Ser. No. 308,173, Feb. 8, 1989, abandoned.

[51] Int. Cl.[5] ..... B05B 1/00; F01N 1/14

[52] U.S. Cl. ..... 239/424; 239/597; 239/DIG. 21; 239/DIG. 22; 181/220

[58] Field of Search ..... 239/DIG. 21, DIG. 22, 239/397.5, 424, 433, 590.5, 597, 589, 601, 265.19, 265.43; 181/220, 262-263

[56] References Cited

U.S. PATENT DOCUMENTS

| | | | |
|---|---|---|---|
| 1,133,711 | 3/1915 | Cornelius . | |
| 2,603,062 | 7/1952 | Weiler et al. | 239/265.43 |
| 3,215,172 | 11/1965 | Ardoin | 239/265.19 |
| 3,263,931 | 8/1966 | Bartek et al. | 239/265.11 |
| 3,666,044 | 5/1972 | Killian | 239/265.19 |
| 3,982,605 | 9/1976 | Sneckenberger | 239/589 X |
| 4,050,632 | 9/1977 | Wyse | 239/DIG. 22 X |
| 4,196,793 | 4/1980 | Teodorescu | 181/262 X |
| 4,306,684 | 12/1981 | Peterson | 239/597 |
| 4,516,660 | 5/1985 | Greenlaw | 239/265.19 |
| 4,813,611 | 3/1989 | Fontana | 239/590.5 X |
| 4,843,770 | 7/1989 | Crane et al. . | |

*Primary Examiner*—Andres Kashnikow
*Assistant Examiner*—William Grant
*Attorney, Agent, or Firm*—Frost & Jacobs

[57] ABSTRACT

A sound attenuating supersonic nozzle has an exit to throat ratio in the range of 2.5 to 6.0, with longitudinal grooves formed in the interior wall of the supersonic passageway of the nozzle body. A shield is disposed about the exterior surface of the nozzle body, forming an exit cavity and an exit opening, and has a gill cavity through which auxiliary air flows into the exit cavity and mixes with the supersonic flow.

42 Claims, 5 Drawing Sheets

NOISE ATTENUATING SUPERSONIC NOZZLE572

This is a continuation of application Ser. No. 308,173, filed Feb. 8, 1989, now abandoned.

TECHNICAL FIELD

The present invention relates generally to supersonic nozzles and is particularly directed to attenuating the noise emitted by supersonic nozzles during operation. The invention will be specifically disclosed in connection with a supersonic nozzle having an exit to throat ratio within a specified range, internal features of the supersonic passageway, and external configurations of the nozzle body which tend to reduce the noise emitted therefrom.

BACKGROUND OF THE INVENTION

Supersonic nozzles are well known in the art. Conventional converging-diverging nozzles include a converging section, a throat, and a diverging section. If sufficient pressure is applied to a converging-diverging nozzle, air velocity of the throat will become sonic, and then increase as the air expands at the diverging section to produce a supersonic outlet velocity. The exact exit velocity depends on air pressure, size, and other details of the nozzle design.

Nozzles may be used for a variety of purposes. They may be operated automatically while located a distance from the operator and other people. Other nozzles may be hand held by an operator who directs the exiting flow in order to achieve a particular purpose. One specific use of such nozzles is in combination with a particle blast cleaning apparatus such as that disclosed in U.S. Pat. No. 4,744,181. Such nozzles are typically of the type hand held by an operator, who directs the flow, which is a mixture of transport gas flowing at a supersonic velocity and carbon dioxide pellets carried along by the transport gas. The flow is directed onto an object to be cleaned by particle blast or cryogenic particle blast cleaning methods.

A major problem with the use of supersonic nozzles is the decibel level of the noise emitted by the nozzle during operation. Such noise becomes a critical factor in the acceptability and use of a particular nozzle design when people are required to be nearby. Furthermore, when such nozzles are used in an enclosed area, such as a factory, the reflective surfaces of the area can tend to increase the decibel level experienced at particular locations.

A sound pressure level of 120 dB on the A scale (dBA) has been determined by OSHA to be the threshold level of pain for a human being. However, in occupational situations, OSHA limits the exposure level of a person to such noises to less than 90 dBA for an eight hour time period. Industry and military standards establish this level at 85 dBA.

Typical prior art nozzles, as used for particle blast cleaning apparatuses, have been measured to emit noise as high as 130 dBA at the operator's position. In particular, the nozzle disclosed by U S. Pat. No. 4,038,786 has been documented to emit noise in the range of 127 dBA. Since the dB scale is logarithymic, a change of three decibels represents a doubling of the sound pressure level. Thus, the difference between the OSHA 120 dBA threshold level of pain and the 127 dBA of the typical prior art nozzle, represents over a fourfold increase in the sound pressure level. When compared to the 90 dBA OSHA limit, this difference is an increase of over 4,000 times the sound pressure level of 90 dBA. When compared to the 85 dBA standard of industry and the military, the 127 dBA level of the typical prior art nozzle has a sound pressure level more than 16,000 times this standard.

As is obvious, the sound emitted by supersonic nozzles must be reduced to as low a level as possible to permit safe continuous operation. While ear protection is available, such protective devices attenuate the noise only in the range of 20 to 25 dBA. This would result in a sound pressure level of the typical 127 dBA prior art nozzle of as low as a 102 dBA at the operator's position. While this would drastically reduce the sound pressure level experienced by the operator, it would still remain above the OSHA, industry, and military limits for eight hours of exposure. Furthermore, in a factory situation, it is unrealistic to require workers in nearby areas who are not involved with the supersonic nozzle use to wear such ear protection. The ultimate goal and solution is to use a supersonic nozzle which has a sound pressure level low enough that an operator wearing approved ear protection devices is subjected to less than 85 dBA. Such a nozzle would have to have a sound pressure level of less than 115 dBA at the operator position. The 115 dBA level would also be acceptable to workers without ear protection devices who are more than 15 feet from the operating nozzle.

SUMMARY OF THE INVENTION

Accordingly, it is a primary object of the present invention to provide a supersonic nozzle which, during operation, emits noise having a sound pressure level of less than 115 dBA at the operator's position.

It is another object of the present invention to provide a supersonic nozzle wherein the shock waves accompanying such supersonic flow are formed within the supersonic passageway of the nozzle prior to the exit of the passageway.

It is yet another object of the present invention to provide a supersonic nozzle which prevents the coalescing of the shock waves generated by the supersonic flow.

Yet another object of the present invention is to provide a supersonic nozzle which may be used in the presence of nearby workers who do not have to wear ear protection devices to meet the OSHA, industry, and military standards for sound pressure level exposure.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved supersonic nozzle is provided which has a passageway formed in a nozzle body which has an inlet, a throat, and an exit. The exit area to throat area ratio is in the range of 2.5 to 6.0 whereby the static pressure of the supersonic flow at the exit is less than the static ambient pressure.

In accordance to a further aspect of the invention, a plurality of longitudinal grooves are formed adjacent the interior wall of the supersonic passageway and adjacent the exit.

According to a further aspect of the invention, the grooves extend from exit inwardly towards the throat to the point along the length of the passageway at which the static pressure of the flow is equal to the static ambient pressure.

In yet another aspect of the invention, the supersonic passageway has an elongated rectangular cross section which is formed by two sets of opposing surfaces and the longitudinal grooves are formed in one set of the opposing surfaces.

In a still further aspect of the invention, a nozzle inlet is connected to the nozzle body which has an inlet passageway which delivers the flow of compressible fluid to the supersonic passageway. The inlet passageway has a circular cross section at its inlet and a rectangular cross section at its outlet.

In accordance to yet another aspect of the invention, a plurality of cavities are formed in the exterior surface of the nozzle body. With subsequent aspects of this invention, the cavities may be filled with a plurality of inserts that are composed of a dissimilar material.

According to a still further aspect of the invention, the cavities are formed longitudinally in the exterior surface of the nozzle body, and may be filled with inserts made of a metal which has a greater density than the material from which the nozzle body is formed.

In a still further aspect of the invention, the supersonic passageway of the nozzle has an exit area to throat area ratio in the range of 2.5 to 6.0, and also has a plurality of longitudinal ribs formed in the supersonic passageway, as well as a plurality of inserts disposed in a plurality of longitudinal cavities formed in the exterior surface of the nozzle body.

In still another aspect of the invention, a shield is disposed about the exterior surface of the nozzle body and extends in the direction of flow beyond the exit, forming an exit opening which is aligned with the exit of the supersonic passageway. The exit opening has a cross sectional area at least as large as the cross sectional area of the exit of the supersonic passageway.

In a still further aspect of the invention, the exit opening is at least 25% larger than the exit opening of the supersonic passageway.

In accordance with another aspect of the invention, means are provided for allowing auxiliary air flow into the exit cavity, with the auxiliary air flow exiting through the exit opening.

In yet another aspect of the invention, a gill cavity is formed between the exterior surface of the nozzle body and the shield.

In still another aspect of the invention, the angle formed between the exterior surface of the nozzle body and the perimeter of the exit opening is at least 60°.

In yet a further aspect of the invention, the shield does not directly contact any portion of the exterior surface of the nozzle body.

Still other objects of the present invention will become apparent to those skilled in this art from the following description wherein there is shown and described preferred embodiments of this invention, simply by way of illustration, of the best modes contemplated for carrying out the invention. As will be realized, the invention is capable of other different embodiments, and that several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the descriptions serve to explain the principles of the invention. In the drawings.

Reference will now be made in detail to the present preferred embodiments of the invention, an example of which is illustrated in the accompanying drawings.

DETAILED DESCRIPTION OF THE PREFERRED EMBODIMENT

Figure 1:
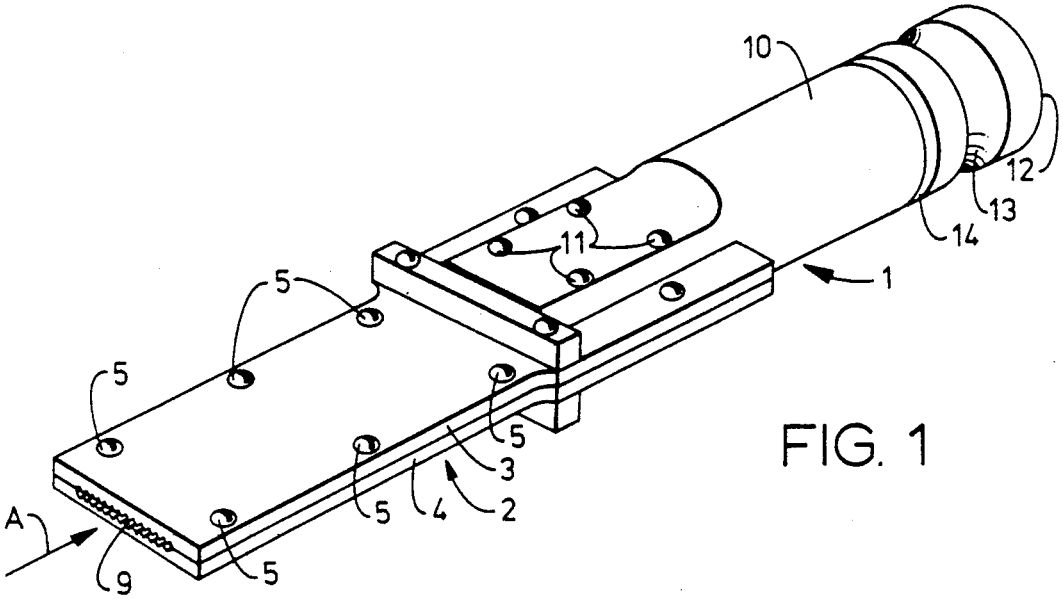
FIG. 1 is a perspective view of a first embodiment of the supersonic nozzle.
Figure 3:
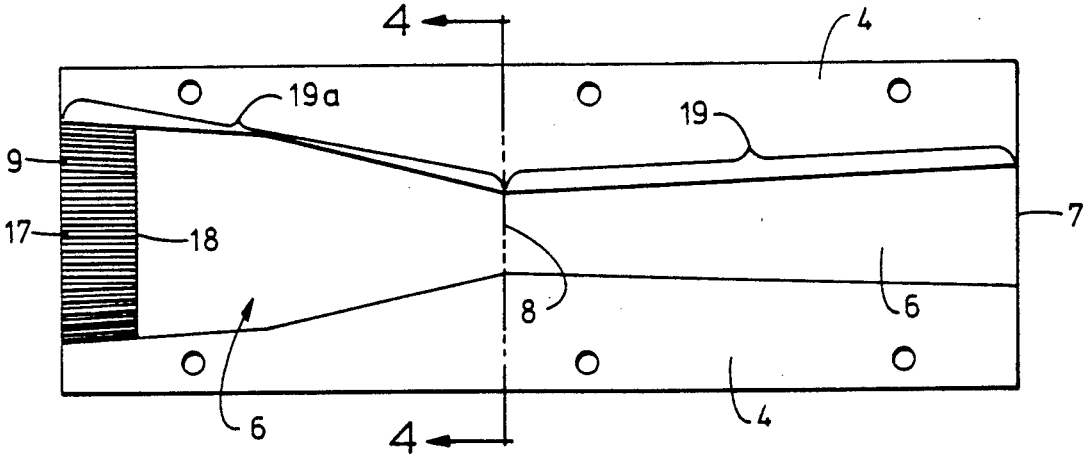
FIG. 3 is a cross sectional view taken along line 3—3 of FIG. 2 showing the supersonic passageway and its profile, as well as longitudinal ribs formed adjacent the exit of the supersonic passageway.

Referring now to the figures, FIG. 1 shows a supersonic nozzle generally designated by the numeral 1 constructed in accordance with the present invention. Nozzle body 2 is shown as being formed of an upper section 3 and a lower section 4, held together by a plurality of fasteners, such as bolts 5. Referring briefly to FIG. 3, the supersonic passageway 6 is formed symmetrically in upper section 3 and lower section 4, and is shown as a profile, having an inlet 7, a throat 8 (FIG. 3), and an exit 9. Returning to FIG. 1, nozzle inlet 10 is shown connected to nozzle body 2 by bolts 11. A passageway (not shown in FIG. 1) is formed through the interior of nozzle inlet 10 which communicates with inlet 7 (FIG. 3) at one end, and is connectable to receive a flow of compressible fluid at the other end 12. A pair of spaced annular grooves 13, 14 are formed about the circumference of nozzle inlet 10 near end 12.

Figure 2:
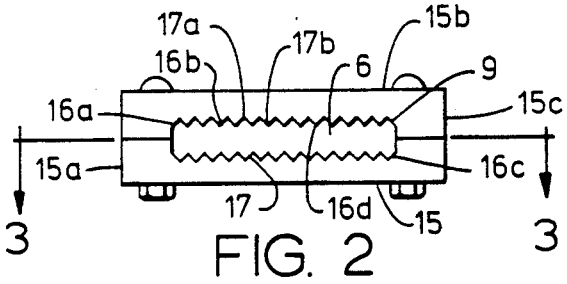
FIG. 2 is an end view along line A of FIG. 1 showing the exit of the supersonic nozzle.

Referring to FIG. 2, which is an end view of nozzle 1, the exterior surface 15 of nozzle body 2 can be seen as being continuous in nature. Passageway 6 and exit 9 are shown as having an elongated rectangular cross sectional shape. In principle, as depicted here, an elongated rectangle has a dimension in one direction which is substantially larger than the dimension in the other direction. The rectangle is formed by an interior wall 16 of supersonic passageway 6. While supersonic passageway 6 is shown as an elongated rectangle in cross section, as will be described later, it may also be circular in cross section. With either shape, an elongated rectangle or a circle, supersonic passageway 6 is considered to have one interior wall 16, although as shown in FIG. 2 with the elongated rectangular cross sectional shape, there are four distinct surfaces, 16A, 16B, 16C, and 16D. As shown, the rectangular cross section can be considered to be constructed of two sets of opposing surfaces 16A and 16C, and 16B and 16D.

Formed in one set of opposing surfaces, 16B and 16D of interior wall 16, are a plurality of grooves 17. Grooves 17 are shown adjacent exit 9 in FIG. 3, as actually starting at exit 9. In practice, grooves 17 may actually begin at from exit 9, or begin a short distance upstream of exit 9. Grooves 17 extend inwardly from exit 9 toward throat 8 along a length of supersonic passageway 6, to point 18. As shown, grooves 17 are formed as a series of recesses 17A and ridges 17B, along interior walls 16B and 16D.

Figure 4:
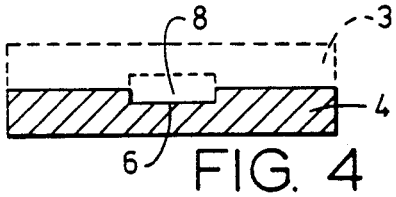
FIG. 4 is a cross sectional view of the throat of the supersonic passageway taken along lines 3—3 of FIG. 3, showing in phantom lines the mating portion of the nozzle body.

Referring again to FIG. 3, supersonic passageway 6 is shown having a converging section 19 from inlet 7 to throat 8. A diverging section 19A is shown from throat 8 to exit 9. FIG. 4 shows a cross section taken through throat 8, showing the rectangular shape thereof, and also indicating that throat 8 has the smallest cross sectional area of any location in supersonic passageway 6.

In operation, end 12 of nozzle inlet 10 is connected to flexible hose (not shown) which delivers a continuous flow of a compressible fluid. As is well understood in the art, compressible fluids are gases and may be accelerated to supersonic flow through a converging-diverging nozzle. Grooves 13 and 14 are adapted to be received by a quick disconnect mechanism (not shown) attached to the hose delivering the flow of compressible fluid. In the present embodiment of the invention, air flows through the circular cross section at end 12 of nozzle inlet 10. The interior cavity (not shown) of nozzle inlet 10 changes from a circular cross section to a rectangular cross section along the length of nozzle inlet 10 to where it is delivered into inlet 7 of supersonic passageway 6. The air flows through converging section 19 where it is accelerated to sonic flow at throat 8. Flowing downstream from throat 8, the sonic flow, following well known laws of physics, is accelerated to a supersonic velocity as it flows through diverging section 19A and leaves the nozzle 1 through exit 9. In a supersonic nozzle which maximizes the flow momentum, the static pressure of the flow at the exit will be equal to 0 psig, or stated another way, will be equal to the static ambient pressure. A nozzle which has a lower static pressure at exit 9 is referred to as an overexpanded - underdeveloped nozzle. In such an overexpanded nozzle, the static pressure of the flow reaches 0 psig at a point upstream of the exit. This reduces the efficiency of the nozzle in terms of maximizing the momentum of the flow exiting the nozzle.

Shock waves form in such supersonic flow as present here at the point at which the static pressure of the flow is equal to 0 psig. In the case of a nozzle having greater than 0 psig static pressure at the exit, shock waves are formed externally at the exit, and travel from the supersonic passageway. It is these shock waves which produce the high sound pressure level of a supersonic nozzle while it is operating.

The present embodiment of the invention lowers the noise generated by the supersonic nozzle 1 by overexpanding the nozzle. Thus, as shown in FIG. 3, the flow through the supersonic nozzle 1 reaches 0 psig static pressure at location 18. It is at this point in supersonic passageway 6 that shock waves form. The shock waves are attenuated as they travel from location 19 through exit 9 and out to the ambient environment. Thus, the noise level is reduced by this design.

The point at which 0 psig static pressure is achieved in supersonic flow is determined by the exit to throat ratio, which is the ratio of the cross sectional area of exit 9 to the cross sectional area of throat 8. In isentropic flow (no losses), the ratio of 2.77 theoretically achieves 0 psig static pressure at the exit. Because ideal flow (no losses) is impossible to achieve, the actual ratio which produces 0 psig static pressure is in fact less than 2.77. Empirically, it has been determined that an exit to throat ratio of 2.48 will produce a static pressure of 0 psig at the exit. Thus, in order to cause the generation of shock waves to occur inside of supersonic passageway 6, an exit to throat ratio of greater than 2.5 is necessary. The inventors have determined that, as a practical matter, an exit to throat ratio of greater than 6.0 is impractical due to boundary layer separation turbulence and the potential of stalling the nozzle.

While maintaining the generation of shock waves within supersonic passageway 6 attenuates some of the noise of the operation of supersonic nozzle 1, another embodiment of the present invention also includes grooves 17 formed in the exterior wall 16 of supersonic passageway 6 as described above. The location of these grooves 17 near exit 9 of supersonic passageway 6, assists in preventing the shock waves from coalescing with one another and thereby enhancing and re-enforcing themselves. Grooves 17 are shown as extending upstream from exit 9 to the point along the length of supersonic passageway 6 at which 0 psig static pressure occurs in the flow. If grooves 17 were to extend beyond this point, there would be some loss in efficiency of the nozzle without any corresponding gain in sound attenuation. This is because the shock waves are not formed upstream of location 18, and, therefore, any portion of grooves 17 extending beyond location 18 will not be functional with respect to preventing the coalescing of shock waves.

As shown in FIG. 2, grooves 17 are formed in interior wall 16, and in particular, on one set of opposing surfaces 16B, 16D. This embodiment operates efficiently when the distance between the grooves 17 from ridge to ridge 17B is 0.030 inches to 0.050 inches. It is particularly efficient when this distance is 0.030 inches. Too great of a distance will reduce the efficiency of the grooves 17 in preventing the coalescing of shock waves.

The depth of grooves 17 from ridge 17B to recess 17A is in the range of 0.005 inches to 0.015 inches. If the grooves 17 are too shallow, the grooves 17 are ineffective in preventing the coalescing of shock waves. If the grooves 17 are too deep, they reduce the efficiency of the nozzle.

Figure 5:
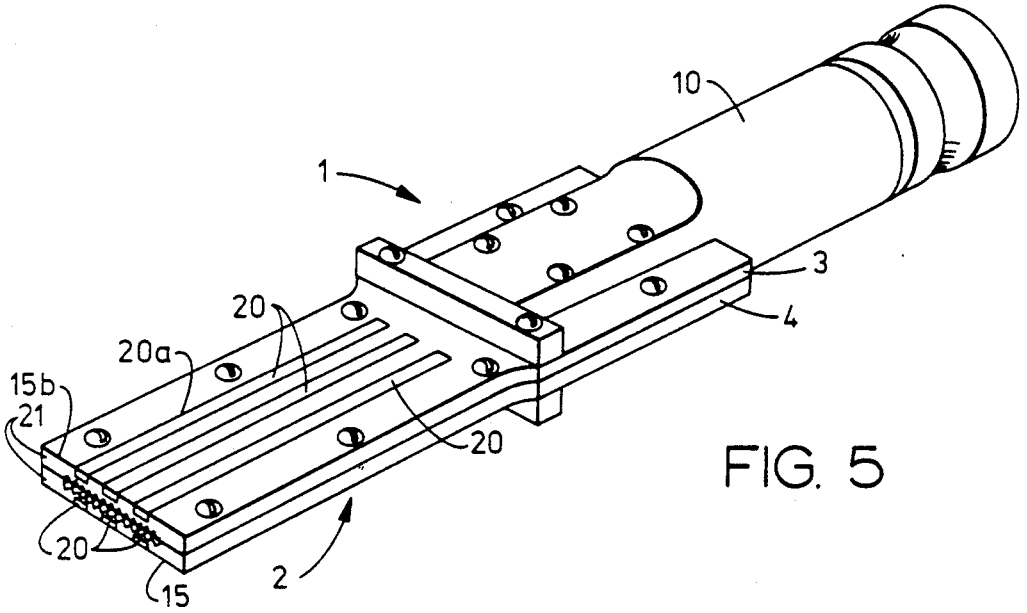
FIG. 5 is a perspective view of a second embodiment of the supersonic nozzle having longitudinal inserts disposed in longitudinal cavities formed in the exterior surface of the nozzle body.

Referring now to FIG. 5, supersonic nozzle 1 is shown having a plurality of inserts 20 complimentary in shape to and disposed in longitudinal cavities 20A formed in exterior surface 15. As indicated, in the present embodiment, inserts 20 are disposed on opposite exterior surfaces 15B and 15D. Inserts 20 and cavities 20A are shown as running the length of nozzle body 2, terminating at end 21 of nozzle body 2. Inserts 20 may be flush with exterior surface 15 as shown or may terminate above or below exterior surface 15. Inserts 20 may be a single piece per cavity 20A or may be layered of several inserts 20 in one cavity 20A.

While nozzle body 2 may be formed of any suitable material, in the present embodiment it is formed of aluminum. Inserts 20 are preferably of a similar material, having a greater density than the material which forms nozzle body 2. In the present embodiment, inserts 20 are made of lead.

Noise generated by the operation of supersonic nozzle 1 may also travel through nozzle body 2, being absorbed and then re-emitted from the nozzle. By disposing inserts 20 in cavities 20A on exterior surface 15 of nozzle body 2, the ability of nozzle body 2 to transmit the noise is reduced. By forming discontinuous shapes, i.e. cavities 20A, in exterior surface 15, resonance in surface 15 is prevented at certain frequencies. Inserts 20 formed of lead, absorb some of the energy of the transmitted sound due to the density of the lead, and thereby reduces the transmission of sound from the surface of the lead.

An alternative embodiment to FIG. 5, is to form cavities 20A in exterior surface 15 of nozzle body 2 without disposing inserts in cavities 20A. As mentioned above, such discontinuity of exterior surface 15 helps to decrease the transmission of sound therefrom. However, also as described, the sound is reduced even further by filling cavities 20A with inserts 20. Although longitudinal cavities and inserts are shown, randomly sized and located cavities and inserts will also produce similar sound attenuation. Although FIG. 5 shows the use of cavities 20A and inserts 20 on a nozzle having grooves 17 in supersonic passageway 6, it should be understood that either may be used alone or in combination.

Figure 6:
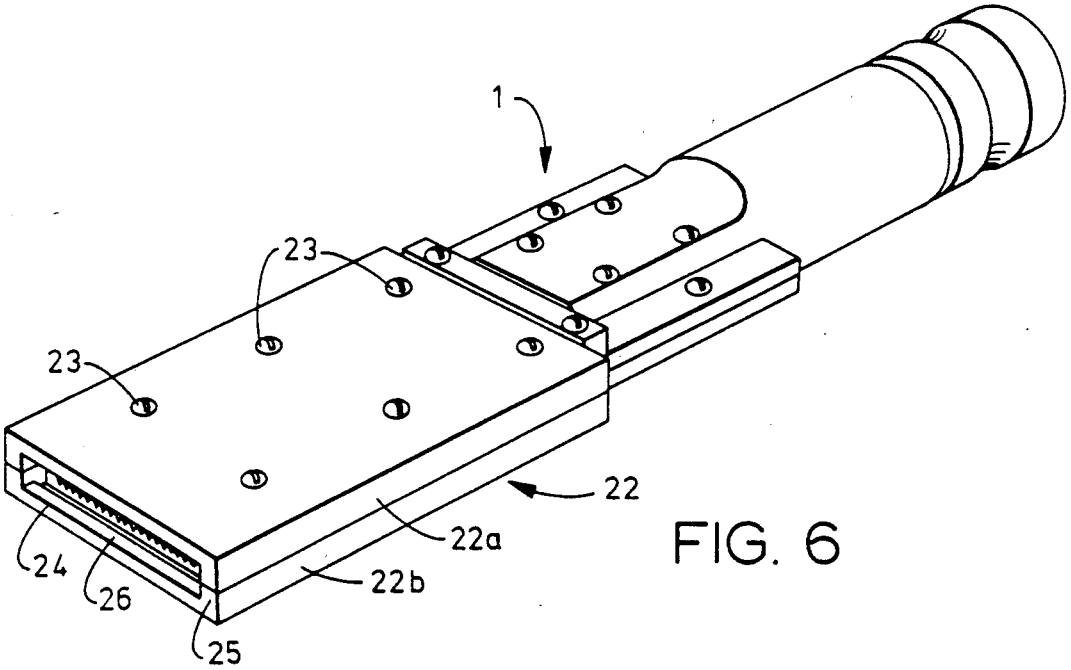
FIG. 6 is a perspective view of a third embodiment of the supersonic nozzle having a shield disposed about the exterior surface of the nozzle body.
Figure 7:
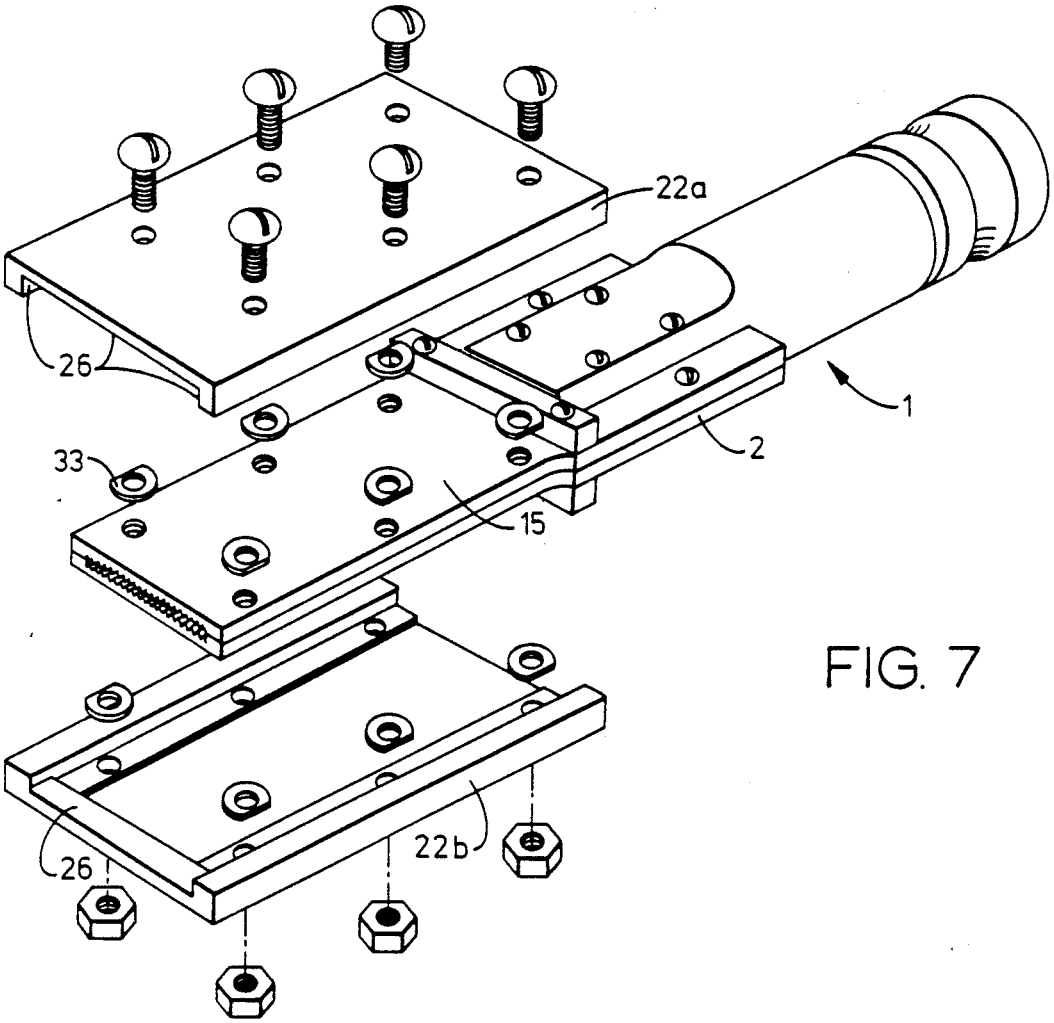
FIG. 7 is an exploded perspective view of the supersonic nozzle and shield of FIG. 6.
Figure 12:
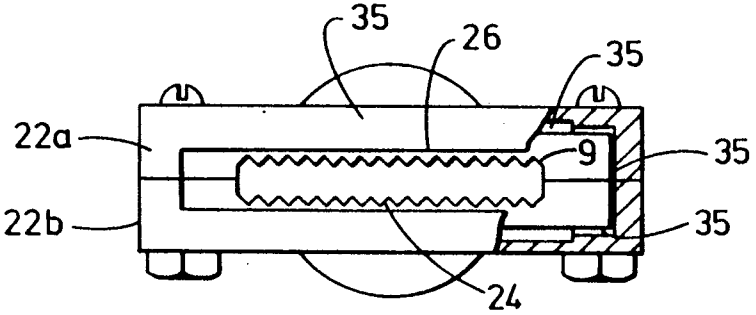
FIG. 12 is an end view of the nozzle of FIG. 6 in partial cross section showing the exit opening and the nozzle exit.

Referring to FIGS. 6 and 7, another embodiment is shown. Supersonic nozzle 1 has a shield 22 disposed about a portion of exterior surface 15 of nozzle body 2. The shield is formed of two portions, 22A, 22B, and is secured by a plurality of bolts 23 which also hold upper section 3 and lower section 4 of nozzle body 2 together. Shield 22 is shown extending beyond exit 9 in the direction of flow. Exit opening 24 is formed at end 25 of shield 22. Exit opening 24 is defined by perimeter 26 and is generally aligned with exit 9 as shown in FIG. 12. Exit opening 24 is larger than exit 9, and as shown, is preferably at least 25% larger than exit 9.

Figure 8:
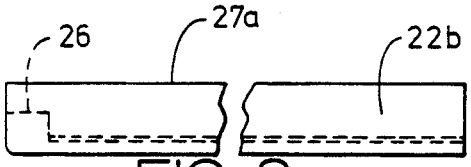
FIG. 8 is a side elevational view of a portion of the shield of FIG. 6.
Figure 9:
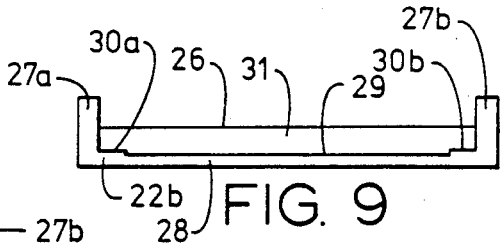
FIG. 9 is an end elevational view of the shield of FIG. 8.
Figure 10:
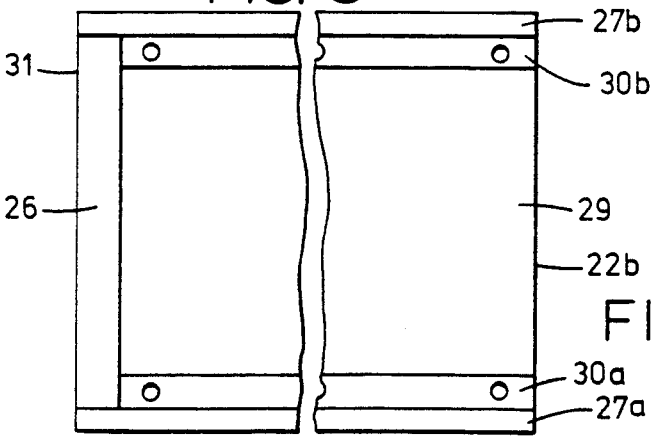
FIG. 10 is a top view of a portion of the shield of FIG. 6.

FIG. 8 shows a side elevational view of shield portion 22B. Referring also FIGS. 9 and 10, shield 22B has sides 27A and 27B extending perpendicularly from wall 28. Relief 29 is shown formed in wall 28, resulting in steps 30A and 30B formed adjacent sides 27A and 27B, respectively. End 31 is formed between side 27A, wall 28, and side 27B at one end of shield 22B. A portion of perimeter 26 is formed by end 31.

Referring to FIG. 7, symmetrical shields 22A and 22B are assembled about nozzle body 2, with spacers 33 located between exterior surface 15 and steps 30A and 30B, thereby preventing any direct contact between shield 22 and nozzle body 2. The distance between sides 27A and 27B is greater than the distance between exterior surfaces 15A and 15C, also preventing any direct contact between shield 22 and nozzle body 2.

Figure 11:
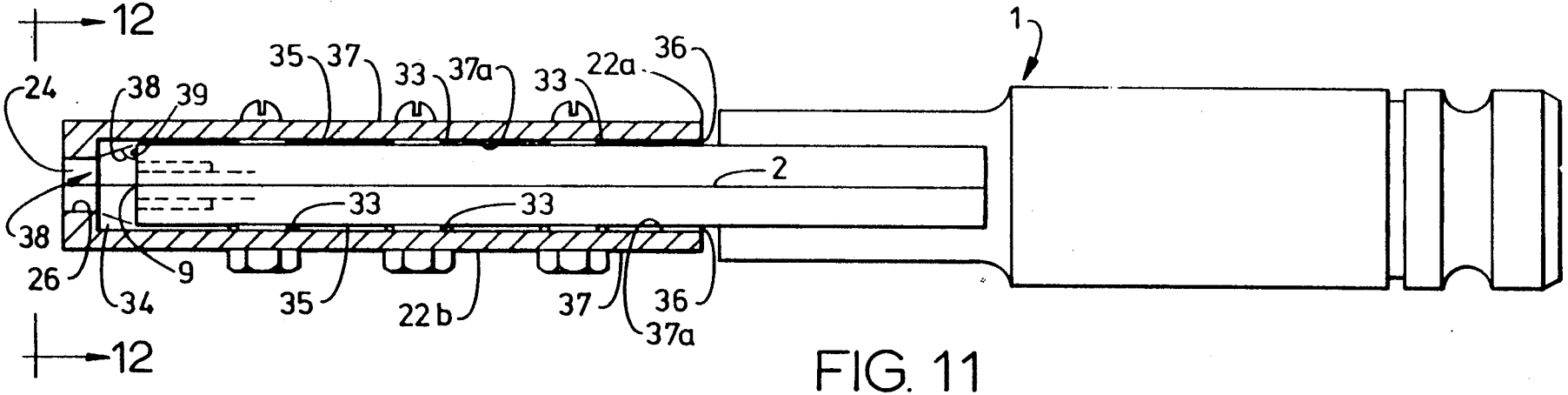
FIG. 11 is a side elevational view with the shield shown in partial cross section showing the nozzle and shield assembly of FIG. 6.

Referring now to FIG. 11, shows shield 22 in partial cross section as disposed about nozzle body 2 of supersonic nozzle 1. Exit cavity 34 is defined by exit 9 of supersonic passageway 6, shield 22A, 22B, and exit opening 24. Formed between shield 22 and exterior surface 15 is an air cavity or gill cavity 35 which communicates with the ambient environment at gill opening 36 at one end, and with exit cavity 34 at the other end. The size of gill cavity 35 is further enhanced by the spacing of shield 22A, 22B from exterior surface 15 by a plurality of spacers 33, and by relief 29 of shield 22B and the corresponding symmetrical relief of shield 22A.

By assembling shield 22 to surround nozzle body 2 as shown in FIGS. 6, 11, and 12, additional sound attenuation is achieved. The transmission of sound from exterior surface 15 of nozzle body 2 is reduced due to the spacing of shield 22A, 22B from exterior surface 15. Sound which reaches shield 22A, 22B is reflected and absorbed by the interior surface 37A of shield 22 and only a portion of the sound is re-emitted from the exterior surface 37 of shield 22. Furthermore, exit cavity 34 acts to attenuate the shock waves emerging with the flow from exit 9 prior to exiting through exit opening 24.

It is important that exit opening 24 not act as the exit of supersonic nozzle 1. To prevent this, an auxiliary air flow passes through gill cavity 35, and exits through exit opening 24 in combination with the supersonic flow from exit 9. The supply of auxiliary air through gill cavity 27 must be sufficient to prevent any effect of exit cavity 34 on the actual supersonic flow at exit 9. Satisfactory auxiliary air flow has been achieved in practice by maintaining the depth of relief 29 formed in shield 22A and 22B at 0.050 inches.

The auxiliary air flow mixes with the supersonic air flow while exiting through exit opening 24. To prevent turbulence and other undesirable effects, it is best if the mixing of the two flows occurs as tangentially as possible. To this end, it has been determined that optimum results are obtained if the angle 38 formed between exterior surface 15 at end 39 of nozzle body 2 and perimeter 26 be no less than 60°, although the nozzle 1 is operable with an angle 38 of less than 60°. Angle 38 is called the gill angle.

It is anticipated that the nozzle body will be formed of aluminum. Shield 22 may be formed of brass or other similar material. Spacers 33 are formed of a fiber material, having poor sound transmission properties, to reduce the transmission of sound from exterior surface 15 through spacers 33 to shield 22. While it is anticipated that shield 22 be used in combination with grooves 17 and a supersonic nozzle having an exit to throat ratio in the range of 2.5 to 6.0, the shield will in fact attenuate sound independent of the presence of grooves 17. Of course, for optimum sound attenuation, the preferred embodiment encompasses all three of these features. Additionally, one skilled in the art may find improvement in the sound attenuation performance of the preferred embodiment by further disposing cavities and inserts (not shown) on exterior surface 37 of shield 22.

FIG. 12 shows an end view of the nozzle of FIG. 6, with shield 22 partially cut away. As can be seen, exit opening 24 is aligned with exit 9. Gill cavity 35 extends completely around nozzle body 2 between exterior surface 15 and interior surface 37A of shield 22.

The inventors have determined that a nozzle according to the present invention, having an exit to throat ratio of 2.69 in combination with grooves formed in the supersonic passageway as described above, will produce a sound pressure level of 112 dBA at the operator position. By adding the shield to this nozzle, further sound attenuation is achieved and the sound pressure level at the operator's location is reduced to as low as 104 dBA.

Figure 13:
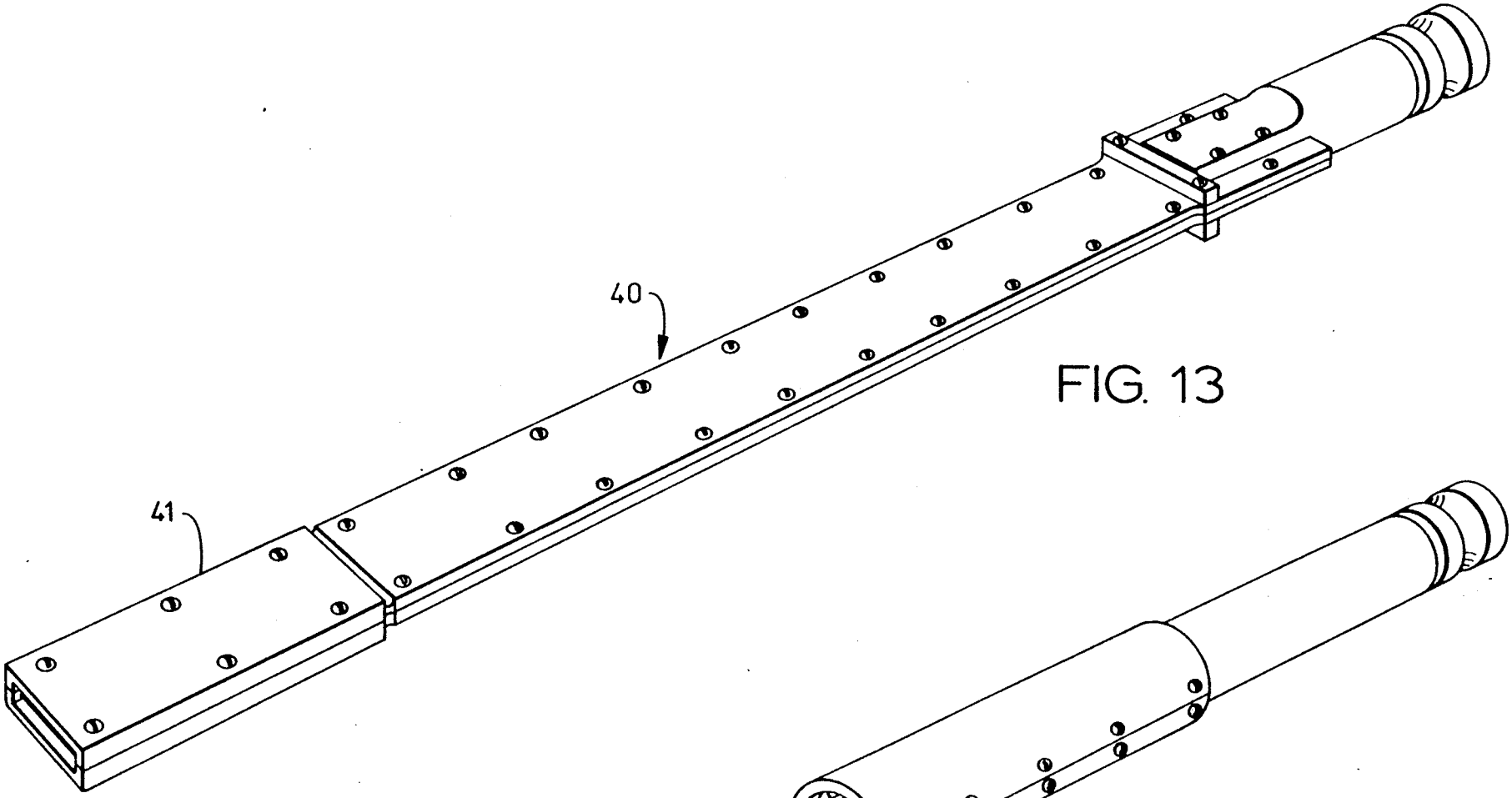
FIG. 13 is a perspective view showing a fourth embodiment of the supersonic nozzle.

FIG. 13 shows another embodiment of the present invention having an elongated nozzle body 40, with shield 41 secured near the end of the nozzle body 40 as described above in conjunction with the embodiment of FIG. 6.

Figure 14:
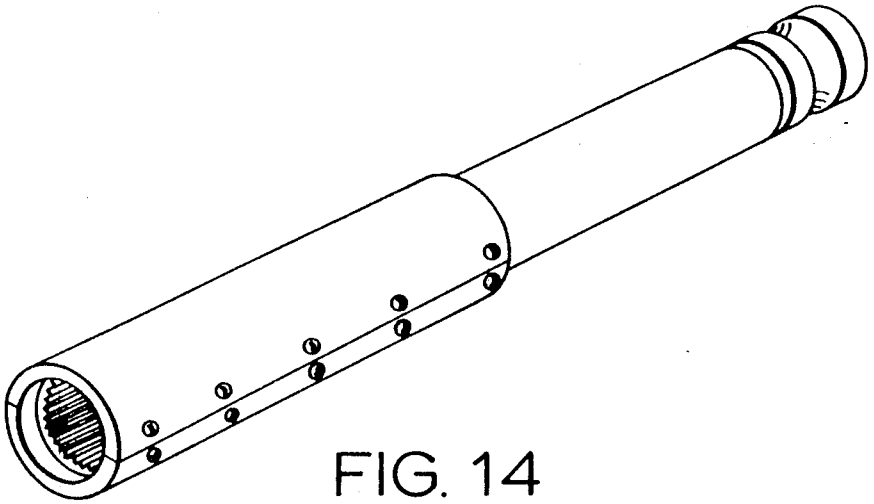
FIG. 14 is a perspective view of a fifth embodiment showing a supersonic nozzle having a circular exit.

FIG. 14 shows another embodiment having a supersonic passageway with a circular cross section in combination with grooves formed in the interior wall of the supersonic passageway, and a shield disposed about the nozzle body, spaced therefrom.

In summary, numerous benefits have been described which result from employing the concepts of the invention. The supersonic nozzle described herein produces highly attenuated sound pressure levels at the operator position, which allows safer and more convenient use thereof.

The foregoing description of preferred embodiments of the invention has been presented for purposes of illustration and description. It is not intended to be exhaustive or to limit the invention to the precise formed disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A sound attenuating supersonic nozzle connectable to a flow of compressible fluid, said nozzle comprising:

(a) a nozzle body having an exterior surface;

(b) a supersonic passageway having an interior wall, said supersonic passageway formed in said nozzle body and having an inlet, a throat, and an exit, said supersonic passageway having a converging section between said inlet and said throat, said supersonic passageway having a diverging section between said throat and said exit, said supersonic passageway adapted for producing sonic flow at said throat and supersonic flow in said diverging section; and (c) means for reducing the coalescence of sound waves, said means comprising a plurality of longitudinal grooves formed in said internal wall adjacent said exit.

2. A nozzle as claimed in claim 1 wherein the exit to throat area ratio of said supersonic passageway is in the range between 2.5 and 6.0.

3. A nozzle as claimed in claim 1 wherein said longitudinal grooves extend from said exit inwardly toward said throat to the point in said diverging section at which the static pressure of the supersonic flow during operation of said nozzle is equal to the static ambient pressure.

4. A nozzle as claimed in claim 1 wherein the depth of said grooves is in the range of 0.005 inches to 0.015 inches.

5. A nozzle as claimed in claim 1 wherein the distance between said grooves is in the range of 0.030 inches to 0.050 inches.

6. A nozzle as claimed in claim 1 wherein said supersonic passageway has an elongated rectangular cross sectional shape formed by two sets of opposing surfaces, said longitudinal grooves being formed in one set of said opposing surfaces.

7. A nozzle as claimed in claim 6 further comprising:

(a) a nozzle inlet connected to said nozzle body; and (b) an inlet passageway formed in said nozzle inlet, said inlet passageway adapted to receive the flow of compressible fluid and to deliver the flow of compressible fluid to said inlet of said supersonic passageway, said inlet passageway having an inlet of circular cross section and an outlet of rectangular cross section.

8. A nozzle as claimed in claim 7 wherein said nozzle inlet is adapted to be used with a quick disconnect mechanism.

9. A sound attenuating supersonic nozzle connectable to a flow of compressible fluid, said nozzle comprising:

(a) a nozzle body having an exterior surface;

(b) a supersonic passageway having an interior wall, said supersonic passageway formed in said nozzle body and having an inlet, a throat, and an exit, said supersonic passageway having a converging section between said inlet and said throat, said supersonic passageway having a diverging section between said throat and said exit, said supersonic passageway adapted for producing sonic flow at said throat and supersonic flow in said diverging section; and (c) means for attenuating sound, said means comprising a plurality of cavities formed in said exterior surface of said nozzle body.

10. A nozzle as claimed in claim 9 further comprising a plurality of inserts, said inserts having complimentary shapes to said cavities, said inserts being disposed in said cavities.

11. A nozzle as claimed in claim 10 wherein said inserts do not extend beyond said exterior surface.

12. A nozzle as claimed in claim 10 wherein said inserts are formed of a material which is different than the material from which said exterior surface of said nozzle body is formed.

13. A nozzle as claimed in claim 9 wherein said cavities are formed longitudinally in said exterior surface.

14. A nozzle as claimed in claim 13 further comprising a plurality of inserts, said inserts having complimentary shapes to said cavities, said inserts being disposed in said cavities.

15. A nozzle as claimed in claim 14 wherein said inserts do not extend beyond said exterior surface.

16. A nozzle as claimed in claim 14 wherein said inserts are formed of a material which is different than the material from which said exterior surface of said nozzle body is formed.

17. A nozzle as claimed in claim 16 wherein said inserts are formed of a material which is denser than the material from which said exterior surface of said nozzle body is formed.

18. A nozzle as claimed in claim 9 wherein the exit to throat area ratio of said supersonic passageway is in the range between 2.5 and 6.0.

19. A sound attenuating supersonic nozzle connectable to a flow of compressible fluid, said nozzle comprising:

(a) a nozzle body having an exterior surface;

(b) a supersonic passageway having an interior wall, said supersonic passageway formed in said nozzle body and having an inlet, a throat, and an ext, said supersonic passageway having a converging section between said inlet and said throat, said supersonic passageway having a diverging section between said throat and said exit, said supersonic passageway adapted for producing sonic flow at said throat and supersonic flow in said diverging section;

(c) a plurality of longitudinal grooves formed in said interior wall adjacent said exit;

(d) a plurality of longitudinal cavities formed in said exterior surface; and (e) a plurality of inserts, said inserts having complimentary shapes to said longitudinal cavities, said inserts being disposed in said cavities.

20. A nozzle as claimed in claim 19 wherein said inserts are formed of a material which is different than the material from which said exterior surface of said nozzle body is formed.

21. A nozzle as claimed in claim 20 wherein said inserts are formed of a material which is denser than the material from which said exterior surface of said nozzle body is formed.

22. A nozzle as claimed in claim 19 wherein said longitudinal grooves extend from said exit inwardly toward said throat to the point in said diverging section at which the static pressure of said supersonic flow during operation of said nozzle is equal to the static ambient pressure.

23. A nozzle as claimed in claim 19 wherein the depth of said grooves is in the range of 0.005 inches to 0.015 inches.

24. A nozzle as claimed in claim 19 wherein the distance between the grooves is in the range of 0.030 inches to 0.050 inches.

25. A nozzle as claimed in claim 19 wherein said supersonic passageway has an elongated rectangular cross sectional shape formed by two sets of opposing surfaces, said longitudinal grooves being formed in one set of said opposing surfaces.

26. A nozzle as claimed in claim 25 further comprising:

(a) a nozzle inlet connected to said nozzle body; and (b) an inlet passageway formed in said nozzle inlet, said inlet passageway adapted to receive the flow of compressible fluid and to deliver the flow of compressible fluid to said inlet of said supersonic passageway, said inlet passageway having an inlet of circular cross section and an outlet of a rectangular cross section.

27. A nozzle as claimed in claim 26 wherein said nozzle inlet is adapted to be used with a quick disconnect mechanism.

28. A nozzle as claimed in claim 19 wherein said inserts do not extend beyond said exterior surface.

29. A sound attenuating supersonic nozzle connectable to a flow of compressible fluid, comprising:

(a) a nozzle body having an exterior surface;

(b) a supersonic passageway having an interior wall, said supersonic passageway formed in said nozzle body and having an inlet, a throat, and an exit, said supersonic passageway having a converging section between said inlet and said throat and a diverging section between said throat and said exit, said supersonic passageway adapted for producing sonic flow at said throat and supersonic flow in said diverging section;

(c) a shield disposed about said exterior surface of said nozzle body and extending in the direction of flow beyond said exit;

(d) an exit opening formed by said shield, said exit opening being aligned with said exit of said supersonic passageway, said exit opening being of a complimentary shape to said exit and having a cross-sectional area at least as large as the cross-sectional area of said exit, said exit opening having a perimeter;

(e) an exit cavity defined by said exit of said supersonic passageway, said shield and said exit opening of said shield; and (f) a gill angle formed between said exterior surface and said perimeter, said gill angle being no greater than 90°.

30. A nozzle as claimed in claim 29 further comprising first means for allowing auxiliary air flow into said exit cavity, said first means including means for allowing said auxiliary air flow to exit through said exit opening of said shield.

31. A nozzle as claimed in claim 30 wherein said first means comprises a gill cavity formed between said exterior surface and said shield, said gill cavity communicating with the ambient environment at one end and with said exit cavity at the other end.

32. A nozzle as claimed in claim 31 wherein said gill angle is at least 60°.

33. A nozzle as claimed in claim 29 wherein said shield does not directly contact any portion of said exterior surface.

34. A nozzle as claimed in claim 33 wherein spacers are disposed between said shield and said exterior surface of said nozzle body.

35. A nozzle as claimed in claim 29 further comprising a plurality of longitudinal grooves formed in said interior wall adjacent said exit thereby preventing the coalescing of shock waves which are created by the supersonic flow during operation of said nozzle in said supersonic passageway.

36. A nozzle as claimed in claim 35 wherein said longitudinal grooves extend from said exit inwardly toward said throat to the point in said diverging section at which the static pressure of the supersonic flow during operation of said nozzle is equal to the static ambient pressure 37. A nozzle as claimed in claim 35 wherein the depth of said grooves is in the range of 0.005 inches to 0.015 inches.

38. A nozzle as claimed in claim 35 wherein the distance between said grooves is in the range of 0.030 inches to 0.050 inches.

39. A nozzle as claimed in claim 38 further comprising:

(a) a nozzle inlet connected to said nozzle body; and (b) an inlet passageway formed in said nozzle inlet, said inlet passageway adapted to receive the flow of compressible fluid and to deliver the flow of compressible fluid to said inlet of said supersonic passageway, said inlet passageway having an inlet of circular cross section and an outlet of rectangular cross section.

40. A nozzle as claimed in claim 39 wherein said nozzle inlet is adapted to be used with a quick disconnect mechanism.

41. A nozzle as claimed in claim 35 wherein said supersonic passageway has an elongated rectangular cross sectional shape formed by two sets of opposing surfaces, and said longitudinal grooves being formed in one set of said opposing surfaces.

42. A nozzle as claimed in claim 29 wherein said exit opening is at least 25% larger than said exit of said supersonic passageway.

* * * * *